US011099508B2

(12) United States Patent
Shinji et al.

(10) Patent No.: US 11,099,508 B2
(45) Date of Patent: Aug. 24, 2021

(54) IMAGE FORMING APPARATUS, IMAGE FORMING METHOD, AND COMPUTER READABLE RECORDING MEDIUM FOR RECORDING PROGRAM

(71) Applicant: CANON KABUSHIKI KAISHA, Tokyo (JP)

(72) Inventors: Takeshi Shinji, Yokohama (JP); Satoshi Nishida, Fujisawa (JP); Isamu Takeda, Machida (JP); Takanori Mitani, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/826,414

(22) Filed: Mar. 23, 2020

(65) Prior Publication Data

US 2020/0310310 A1 Oct. 1, 2020

(30) Foreign Application Priority Data

Mar. 26, 2019 (JP) ..... JP2019-058977

(51) Int. Cl.
*G03G 15/20* (2006.01)
*G03G 15/00* (2006.01)

(52) U.S. Cl.
CPC ..... *G03G 15/2039* (2013.01); *G03G 15/2042* (2013.01); *G03G 15/6585* (2013.01)

(58) Field of Classification Search
CPC ..... G03G 15/5062; G03G 15/2039; G03G 15/658; G03G 15/2042; G03G 2215/2035; G03G 15/2053
See application file for complete search history.

(56) References Cited

U.S. PATENT DOCUMENTS

| | | | | |
|---|---|---|---|---|
| 9,075,356 | B2 | 7/2015 | Ooyanagi | |
| 9,091,974 | B2 | 7/2015 | Yoshioka | |
| 9,377,742 | B2 * | 6/2016 | Takamizawa ..... | G03G 15/6585 |
| 2005/0074248 | A1 * | 4/2005 | Akita ..... | G03G 15/5029 399/45 |

(Continued)

FOREIGN PATENT DOCUMENTS

| | | | |
|---|---|---|---|
| JP | 2008268784 | A | 11/2008 |
| JP | 2012048043 | A | 3/2012 |

(Continued)

*Primary Examiner* — Walter L Lindsay, Jr.
*Assistant Examiner* — Jessica L Eley
(74) *Attorney, Agent, or Firm* — Rossi, Kimms & McDowell LLP

(57) ABSTRACT

An image forming apparatus, including: a dividing the image data into regions including pixels; an obtaining a first ratio by dividing a total number of the pixels included in groups, the pixels having a density equal to or higher than a predetermined value and arranged consecutively in a predetermined direction, by a total number of the pixels having the density and included in each of the regions; an obtaining a second ratio by dividing the total number of pixels having the density and included in each of the regions by a total number of the pixels included in each of the regions; a determining a target temperature for maintaining a temperature of a fixing portion based on the first and second ratios; and a controlling power to be supplied to the fixing portion so that the fixing portion is maintained at the target temperature.

14 Claims, 11 Drawing Sheets

| | 1ST IMAGE | 2ST IMAGE | 3ST IMAGE | 4ST IMAGE | 5ST IMAGE |
|---|---|---|---|---|---|
| IMAGE |  |  |  |  |  |
| CONTINUITY C THRESHOLD DETERMINATION | NO | YES | YES | NO | YES |
| CONTINUITY C2 THRESHOLD DETERMINATION | NO | YES | YES | NO | NO |
| COVERAGE RATIO R THRESHOLD DETERMINATION | NO | YES | YES | YES | NO |
| 1ST EMBODIMENT IMAGE TYPE | 1 | 2 | 2 | 2 | 2 |
| 2ST EMBODIMENT IMAGE TYPE | 1 | 2 | 2 | 2 | 1 |

(56) References Cited

U.S. PATENT DOCUMENTS

| | | | | |
|---|---|---|---|---|
| 2013/0045021 | A1* | 2/2013 | Yoshioka | G03G 15/5041 399/69 |
| 2013/0278943 | A1* | 10/2013 | Kurosawa | G03G 15/6585 358/1.1 |
| 2014/0072321 | A1* | 3/2014 | Ooyanagi | G03G 13/20 399/69 |
| 2015/0098740 | A1* | 4/2015 | Yukie | G03G 15/6585 399/341 |
| 2015/0250312 | A1* | 9/2015 | Barrett | A47B 88/463 312/319.1 |

FOREIGN PATENT DOCUMENTS

| | | | |
|---|---|---|---|
| JP | 2013041118 | A | 2/2013 |
| JP | 2014074894 | A | 4/2014 |

* cited by examiner

FIG.8

| | 1ST IMAGE | 2ST IMAGE | 3ST IMAGE | 4ST IMAGE |
|---|---|---|---|---|
| IMAGE | | | | |
| CONTINUITY C COMPARISON WITH THRESHOLD | NO | YES | YES | NO |
| COVERAGE RATIO R COMPARISON WITH THRESHOLD | NO | YES | YES | YES |
| IMAGE TYPE | 1 | 2 | 2 | 2 |

FIG.10

| | 1ST IMAGE | 2ST IMAGE | 3ST IMAGE | 4ST IMAGE | 5ST IMAGE |
|---|---|---|---|---|---|
| IMAGE | | | | | |
| CONTINUITY C THRESHOLD DETERMINATION | NO | YES | YES | NO | YES |
| CONTINUITY C2 THRESHOLD DETERMINATION | NO | YES | YES | NO | NO |
| COVERAGE RATIO R THRESHOLD DETERMINATION | NO | YES | YES | YES | NO |
| 1ST EMBODIMENT IMAGE TYPE | 1 | 2 | 2 | 2 | 2 |
| 2ST EMBODIMENT IMAGE TYPE | 1 | 2 | 2 | 2 | 1 |

IMAGE FORMING APPARATUS, IMAGE FORMING METHOD, AND COMPUTER READABLE RECORDING MEDIUM FOR RECORDING PROGRAM

BACKGROUND OF THE INVENTION

Field of the Invention

The present invention relates to an image forming apparatus including a heat fixing apparatus such as a printer and a copier, an image forming method, and a program.

Description of the Related Art

An electrophotographic image forming apparatus such as a printer and a copier is provided with a heat fixing apparatus (fixer) for thermally fixing a toner image formed on a paper sheet. According to a known method, the fixability of an image is determined on the basis of image information about the image, and a fixing temperature (target temperature) is controlled accordingly.

SUMMARY OF THE INVENTION

According to the method, however, depending on the image pattern, the necessary fixing temperature may be overestimated. According to Japanese Patent Application Publication No. 2008-268784, the fixing temperature is controlled on the basis of a print ratio calculated from the number of pixels for each of a plurality of fixing regions, while even with the same print ratio, the fixing temperature may be overestimated with respect to the necessary fixing temperature for different image shapes. According to Japanese Patent Application Publication No. 2014-74894, the fixing temperature is controlled on the basis of the size of a region having consecutive pixels, and the fixing temperature may be overestimated for example for an image such as a ruled line.

With the foregoing in view, it is an object of the present invention to determine a target temperature appropriate for an image.

In order to achieve the object described above, an image forming apparatus, including:

a fixing portion configured to fix a toner image formed in accordance with image data on a recording material;

a processing portion configured to divide the image data into a plurality of regions including a plurality of pixels;

a first obtaining portion configured to obtain, for each of the plurality of regions, a first ratio by dividing a total number of the pixels included in a plurality of groups, the pixels having a density equal to or higher than a predetermined value and arranged consecutively in a predetermined direction, by a total number of the pixels having the density equal to or higher than the predetermined value and included in each of the regions;

a second obtaining portion configured to obtain, for each of the regions, a second ratio by dividing the total number of the pixels having the density equal to or higher than the predetermined value and included in each of the regions by a total number of the pixels included in each of the regions;

a first determining portion configured to determine a target temperature for maintaining a temperature of the fixing portion on the basis of the first and second ratios; and a control portion configured to control power to be supplied to the fixing portion so that the temperature of the fixing portion is maintained at the target temperature.

In order to achieve the object described above, an image forming method for an image forming apparatus including a fixing portion configured to fix a toner image formed in accordance with image data on a recording material, a computer executing the following steps:

a processing step of dividing the image data into a plurality of regions including a plurality of pixels;

a first obtaining step of obtaining, for each of the plurality of regions, a first ratio by dividing a total number of the pixels included in a plurality of groups, the pixels having a density equal to or higher than a predetermined value and arranged consecutively in a predetermined direction, by a total number of the pixels having the density equal to or higher than the predetermined value and included in each of the regions;

a second obtaining step of obtaining, for each of the regions, a second ratio by dividing the total number of the pixels having the density equal to or higher than the predetermined value and included in each of the regions by a total number of the pixels included in each of the regions;

a determining step of determining a target temperature for maintaining a temperature of the fixing portion on the basis of the first and second ratios; and a control step of controlling power to be supplied to the fixing portion so that the temperature of the fixing portion is maintained at the target temperature.

In order to achieve the object described above, a computer-readable recording medium recording a program, the program causing a computer to execute:

a processing step of dividing the image data into a plurality of regions including a plurality of pixels;

a first obtaining step of obtaining, for each of the plurality of regions, a first ratio by dividing a total number of the pixels included in a plurality of groups, the pixels having a density equal to or higher than a predetermined value and arranged consecutively in a predetermined direction, by a total number of the pixels having the density equal to or higher than the predetermined value and included in each of the regions;

a second obtaining step of obtaining, for each of the regions, a second ratio by dividing the total number of the pixels having the density equal to or higher than the predetermined value and included in each of the regions by a total number of the pixels included in each of the regions;

a determining step of determining a target temperature for maintaining a temperature of a fixing portion on the basis of the first and second ratios, the fixing portion fixing a toner image formed in accordance with the image data on a recording material; and a control step of controlling power to be supplied to the fixing portion so that the temperature of the fixing portion is maintained at the target temperature.

According to the present invention, a target temperature appropriate for an image can be determined.

Further features of the present invention will become apparent from the following description of exemplary embodiments with reference to the attached drawings.

BRIEF DESCRIPTION OF THE DRAWINGS

FIG. 8 is a view for illustrating image type determination processing according to the first embodiment;

FIG. 10 is a view for illustrating image type determination according to the second embodiment;

DESCRIPTION OF THE EMBODIMENTS

Hereinafter, embodiments of the present invention will be described in detail with reference to the drawings. However, it is to be understood that dimensions, materials, shapes, relative arrangements, and the like of components described in the embodiments are intended to be changed as deemed appropriate in accordance with configurations and various conditions of apparatuses to which the present invention is to be applied and are not intended to limit the scope of the present invention to the embodiments described below.

First Embodiment

A first embodiment will be described with reference to FIGS. 1 to 8.

Figure 1:
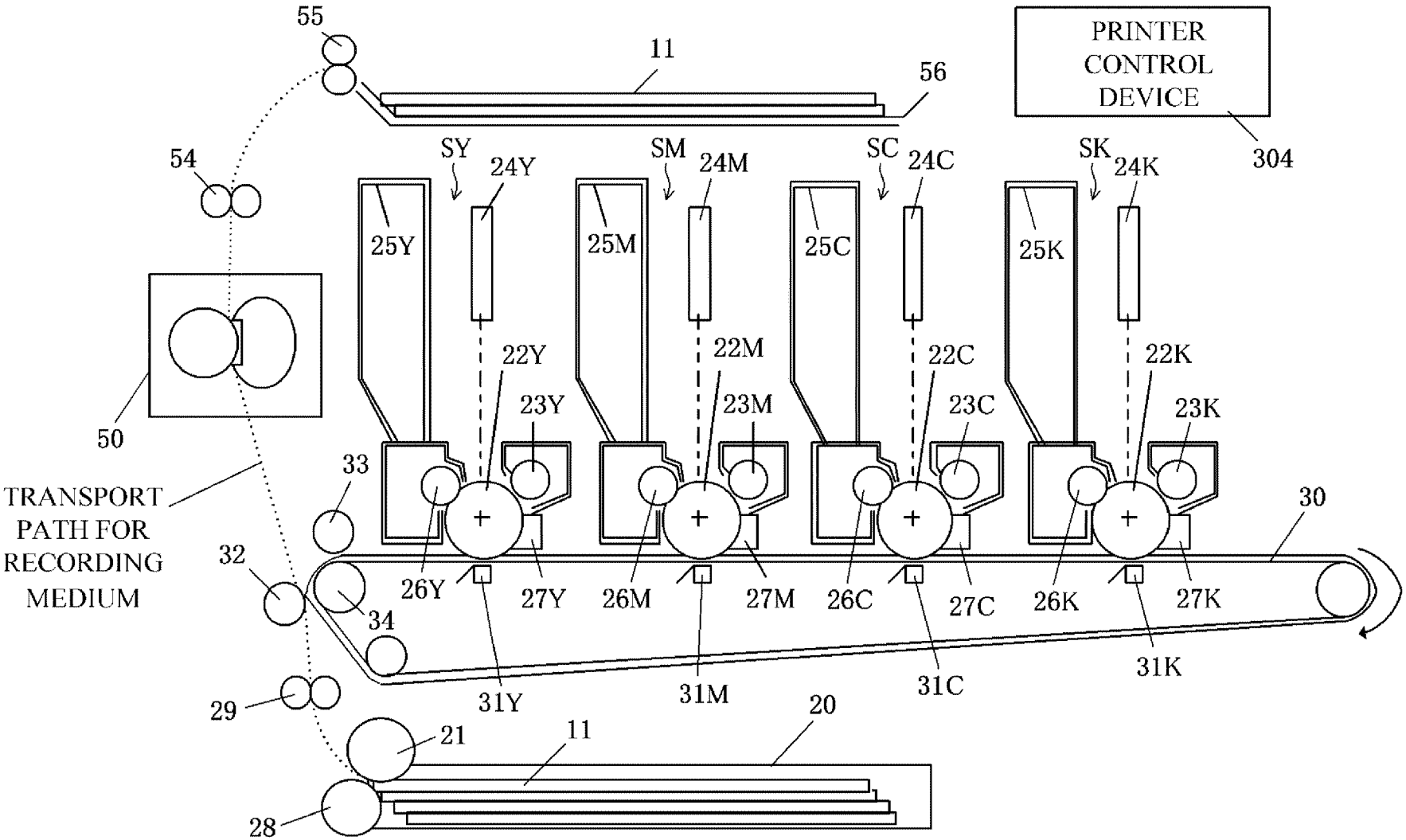
FIG. 1 is a view of a color image forming apparatus according to a first embodiment.

FIG. 1 is a view of an in-line color image forming apparatus as an exemplary electrophotographic image forming apparatus.

The operation of the electrophotographic color image forming apparatus will be described with reference to FIG. 1.

The color image forming apparatus includes a sheet feed unit 20, a photosensitive member (hereinafter referred to as a photosensitive drum) 22 (22Y, 22M, 22C, and 22K) and a charger 23 (23Y, 23M, 23C, and 23K) for each of development color stations. The color image forming apparatus also includes a toner cartridge 25 (25Y, 25M, 25C, and 25K) and a developer 26 (26Y, 26M, 26C, and 26K). The color image forming apparatus also includes an intermediate transfer member 30, primary transfer means 31 (31Y, 31M, 31C, and 31K), secondary transfer means 32, charging means 33 for residual toner, and a fixing unit (thermally fixing apparatus) 50.

An electrostatic latent image is formed on the photosensitive drum 22 by exposure controlled by a printer control device 304 on the basis of an image signal, and a single-color toner image is formed on the photosensitive drum 22 by developing the electrostatic latent image. Single-color toner images are placed on each other to form a multicolor toner image, and the multicolor toner image is transferred onto a recording medium (recording material) 11. Heat and pressure are applied to the recording medium 11 in the fixing unit 50, so that the multicolor toner image is fixed on the recording medium 11.

The photosensitive drum 22 includes an aluminum cylinder and an organic photoconduction layer applied on the outer circumference of the cylinder and rotates anti-clockwise by driving force transmitted from a drive motor which is not shown. The color image forming apparatus includes four chargers 23Y, 23M, 23C, and 23K as charging means for charging the photosensitive drums 22 for yellow (Y), magenta (M), cyan (C), and black (K) at corresponding stations. The surface of the photosensitive drum 22 is selectively exposed by laser light emitted from the laser scanner 24 (24Y, 24M, 24C, and 24K), so that an electrostatic latent image is formed on the photosensitive drum 22.

The color image forming apparatus includes four developers 26Y, 26M, 26C, and 26K that perform development of yellow (Y), magenta (M), cyan (C), and black (K) at corresponding stations in order to visualize the electrostatic latent image as developing means.

The intermediate transfer member 30 is made of a resin endless belt and in contact with the photosensitive drums 22. The intermediate transfer member 30 rotates clockwise by a drive motor (not shown). The intermediate transfer member 30 rotates as the photosensitive drum 22 rotates according to the image forming operation, and voltage is applied to the primary transfer means 31, so that the single-color toner image is transferred onto the intermediate transfer member 30 (primary transfer). The residual transfer toner remaining on the photosensitive drums 22 is recovered by the cleaning means 27 (27Y, 27M, 27C, and 27K) disposed on each of the photosensitive drums 22.

The recording medium 11 prepared at the sheet feed unit 20 is fed by a sheet feed roller 21 and a retard roller 28 and is sandwiched and transported by resist rollers 29. Thereafter, the intermediate transfer member 30 and the secondary transfer means 32 disposed in abutment against the intermediate transfer member 30 sandwich and transfer the recording medium 11, and voltage is applied to the secondary transfer means 32, so that a multicolor toner image on the intermediate transfer member 30 is transferred onto the recording medium 11 (secondary transfer). The residual toner charging means 33 charges the toner remaining on the intermediate transfer member 30. The residual toner remaining on the intermediate transfer member 30 after the multicolor toner image is transferred to the recording medium 11 is charged to the polarity opposite to the original polarity by the residual toner charging means 33. The residual toner is electrostatically recovered onto the photosensitive drums 22 by the primary transfer means 31 and collected by the cleaning means 27.

The fixing unit 50 melts and fixes the multicolor toner image transferred to the recording medium 11 while carrying the recording medium 11 in a sandwiched manner, details of which will be described.

After the toner image is fixed, the recording medium 11 is discharged to the discharge tray 56 by the discharge rollers 54 and 55, and the image forming operation ends.

The printer control device 304 according to the first embodiment will be described with reference to FIGS. 2A and 2B.

Figure 2A:
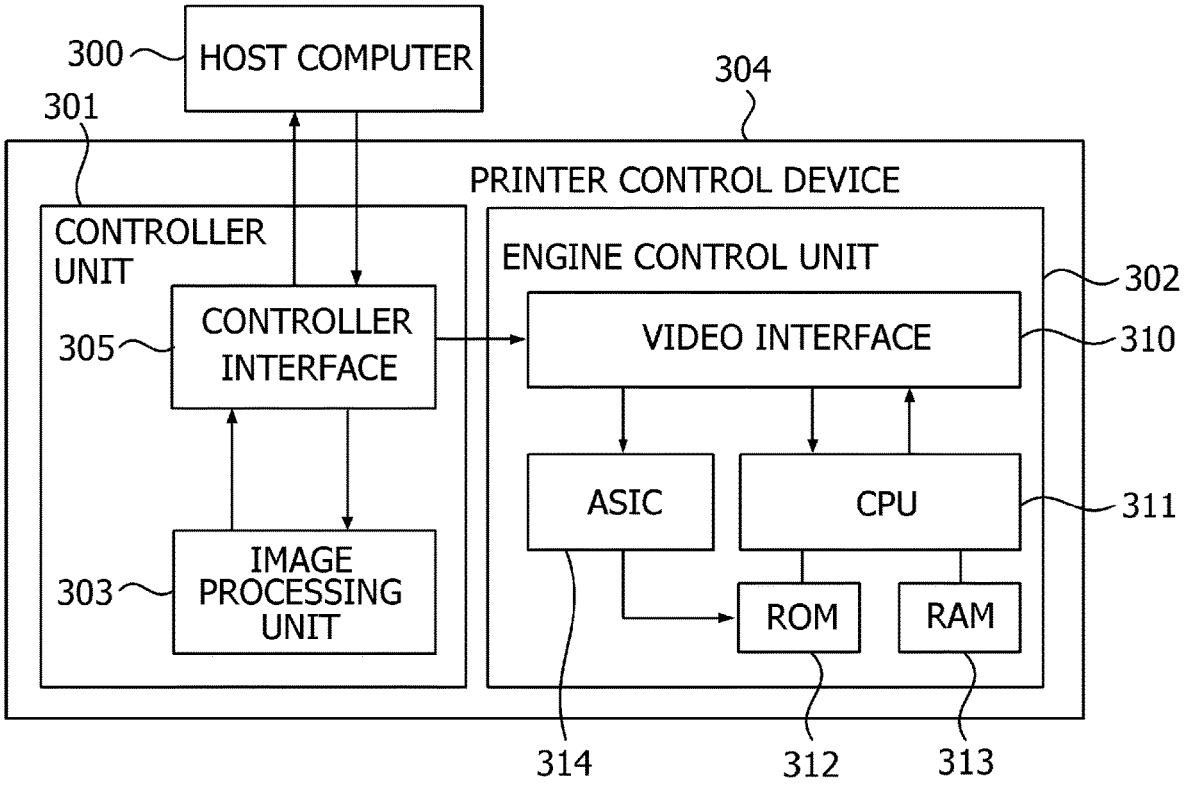
FIG. 2A is a view of a printer system according to the first embodiment.
Figure 2B:
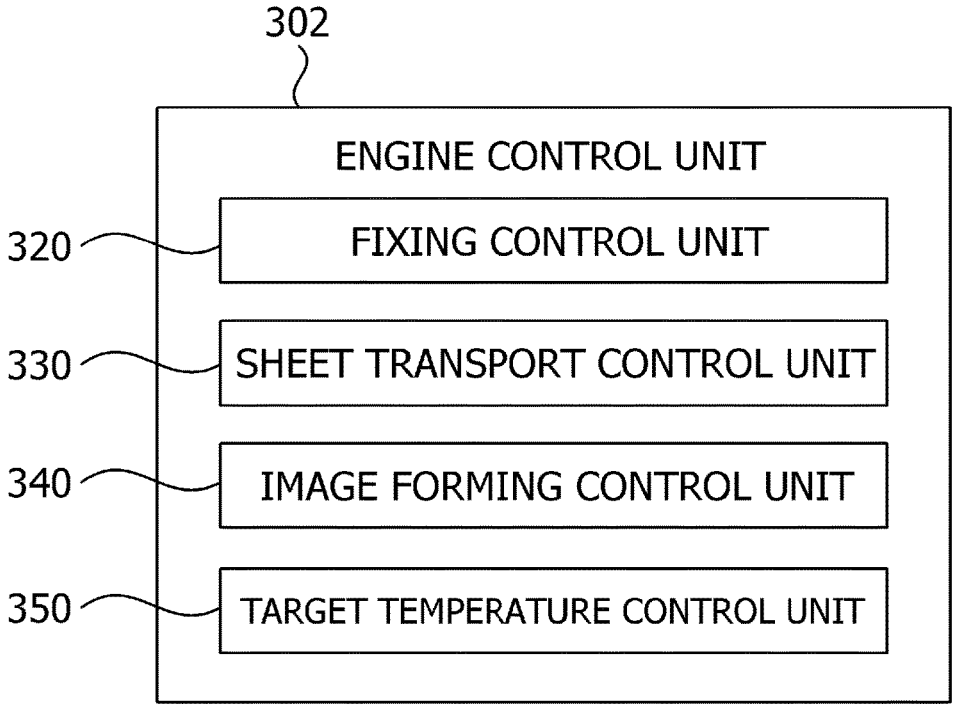
FIG. 2B is a view of an exemplary functional part of an engine control unit according to the first embodiment.

FIGS. 2A and 2B illustrate a printer system (image forming system) according to the first embodiment. The printer control device 304 is incorporated in the color image forming apparatus which communicates with a host computer 300. The host computer 300 may be a server or a personal computer on a network such as the Internet or a local area network (LAN), or a portable information terminal such as a smartphone or a tablet terminal. The printer control device 304 connects and communicates with the host computer 300 using a controller interface 305.

The printer control device 304 is roughly divided into a controller unit 301 and an engine control unit 302. The controller unit 301 includes an image processing unit 303 and a controller interface 305. The image processing unit 303 performs bit mapping of a character code or half-toning processing such as dithering of an intermediate tone image on the basis of information received from the host computer 300 through the controller interface 305. The image processing unit 303 transmits image information to the video interface 310 of the engine control unit 302 through the controller interface 305. The image information includes information for controlling the lighting timing for a laser scanner 24, a printing mode for controlling process conditions such as a target temperature (temperature control temperature) at which the temperature of the fixing unit 50 is maintained and a transfer bias, and image size information.

The controller unit 301 transmits the lighting timing information on the laser scanner 24 to an application specific integrated circuit (ASIC) 314. The ASIC 314 controls a part of the image forming unit such as the laser scanner 24.

Meanwhile, the information such as the printing mode and the image size is transmitted to a central processing unit (CPU) 311. The CPU 311 is also referred to as a processor. The CPU 311 is not limited to a single processor but may include multiple processors. The CPU 311 stores information in a RAM 313 as required, uses programs stored in a ROM 312 or the RAM 313, and refers to information stored in the ROM 312 or the RAM 313. The CPU 311 performs various kinds of control to the engine control unit 302 using the ROM 312 or the RAM 313. The controller unit 301 also transmits for example a printing command and a cancellation instruction to the engine control unit 302 in response to an instruction given by the user on the host computer, and controls operation such as starting and cancellation of printing operation.

FIG. 2B is a diagram for illustrating an exemplary functional portion of the engine control unit 302. As illustrated in FIG. 2B, the engine control unit 302 includes a fixing control unit 320, a sheet transport control unit 330, an image forming control unit 340, and a target temperature control unit 350. As the CPU 311 performs various kinds of control to the engine control unit 302, the engine control unit 302 functions as the units shown in FIG. 2B. The fixing control unit 320 controls the temperature of the fixing unit 50. The sheet transport control unit 330 controls the operation interval of the sheet feed unit 20. The image forming control unit 340 performs process speed control, development control, charging control, and transfer control. The target temperature control unit 350 for example determines, changes, and sets the target temperature. The processing performed by the color image forming apparatus may partly be performed by the host computer 300 or a server on a network. The processing performed by the engine control unit 302 and the image processing unit 303 may be performed partly or entirely by the host computer 300 or a server on a network. The host computer 300 and the server on the network are examples of the processing device. In addition, the processing performed by the engine control unit 302 may be performed partly or entirely by the image processing unit 303, or the processing performed by the image processing unit 303 may be performed partly or entirely by the engine control unit 302.

Fixing Unit

The film-heating type fixing unit 50 according to the first embodiment will be described with reference to FIG. 3. The fixing unit 50 includes a film unit 51 as a heating device and a pressure roller 52.

The film unit 51 includes a fixing film 64 as a fixing member, a heater 63 as a heating member, and a heater holder 65 as a heater holding member. The fixing film 64 is in the shape of a cylindrical rotor. The pressure roller 52 as a pressing member is disposed to oppose the film unit 51. The pressure roller 52 is an elastic rotor.

The fixing unit 50 having the configuration allows the recording medium 11 having an unfixed toner image t thereon to be sandwiched and transported at a pressure contact nip part (fixing nip part) N formed by the heater 63 and the pressure roller 52 through the fixing film 64. As a result, the toner image t is fixed on the recording medium 11. More specifically, the fixing unit 50 fixes the toner image t formed according to the image data on the recording medium 11.

Heater

Figure 3:
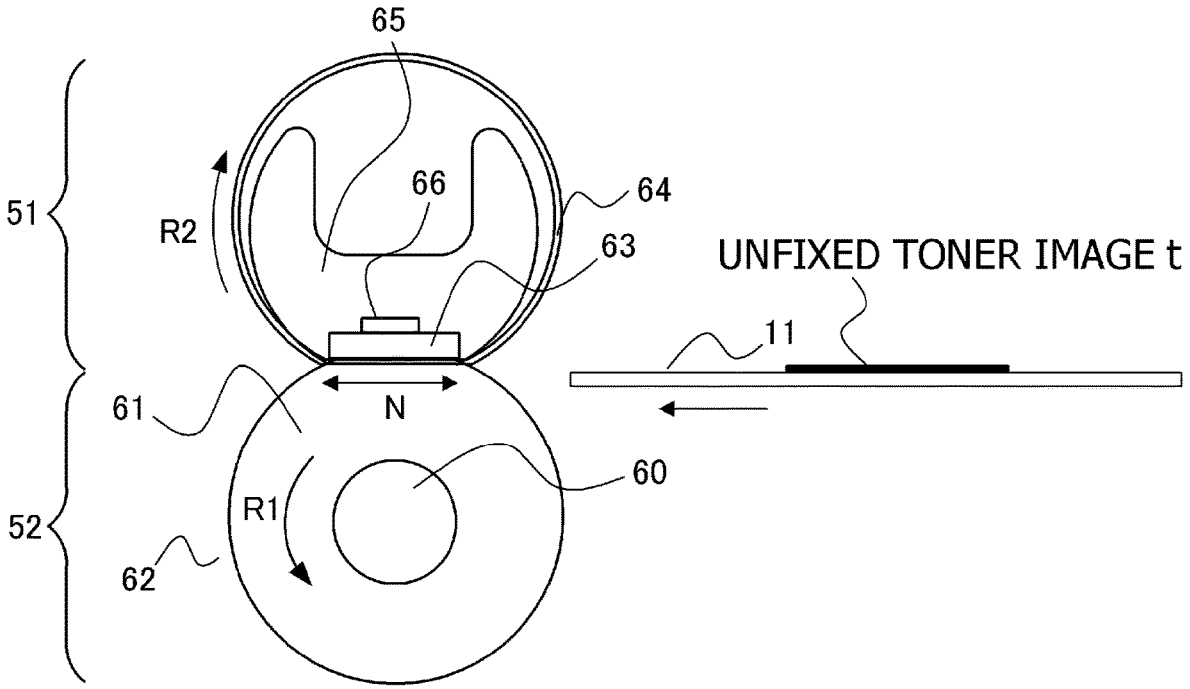
FIG. 3 is a sectional view of a fixing unit according to the first embodiment.

As shown in FIG. 3, the heater 63 is disposed inside the fixing film 64. The heater 63 includes a substrate of ceramic such as alumina and a resistive heat-generating layer of for example a silver palladium alloy formed on the ceramic substrate. In order to secure the insulation and abrasion resistance of the resistive heat-generating layer of the heater 63, the resistive heat-generating layer is covered with overcoat glass, and the overcoat glass contacts the inner peripheral surface of the fixing film 64. A small amount of lubricant such as heat resistant grease is applied to the surface of the heater 63. This allows the fixing film 64 to rotate smoothly. As for the size, the substrate of the heater 63 according to the first embodiment has a width of 6.0 mm, a length of 260.0 mm, and a thickness of 1.00 mm. The thermal expansion coefficient of the substrate is $7.6\times10^{-6}$/° C. The total resistance value of the resistive heat-generating layer of the heater 63 is 20Ω, and the temperature dependence of the resistivity is 700 ppm/° C.

A thermistor 66 as a temperature sensing member is disposed in abutment against the surface opposite to the sliding surface of the heater 63 against the fixing film 64. The fixing control unit 320 controls current passed through the heater 63 on the basis of the temperature sensed by the thermistor 66 so that the heater 63 is kept at a desired temperature. For example, the fixing control unit 320 controls the temperature of the heater 63 by controlling the current passed through the heater 63 in response to a signal from the thermistor 66. The fixing control unit 320 may sense the temperature of the heater 63 as the temperature of the fixing unit 50. The fixing control unit 320 may control power supplied to the fixing unit 50 so that the fixing unit 50 is maintained at a target temperature. For example, the temperature of the fixing unit 50 may be controlled as the fixing control unit 320 controls the current passed through the fixing unit 50 in response to a signal from the thermistor 66. The fixing control unit 320 is an example of a control portion.

Fixing Film

The fixing film 64 is a composite layer film obtained by coating or tube-coating the surface of a thin metal elementary tube for example of SUS with a releasable layer of PFA, PTFE, FEP, or the like directly or through a primer layer. A base layer in a tubular form obtained by kneading a heat-resistant resin such as polyimide and a heat-conducting filler such as graphite may be used instead of the metal elementary tube. The fixing film 64 according to the first embodiment is a film obtained by coating a base layer of polyimide with PFA. The total film thickness of the fixing film 64 is 70 μm, and the outer peripheral length of the fixing film 64 is 57 mm.

Pressure Roller

The pressure roller 52 includes a core bar 60 made for example of iron, an elastic layer 61, and a release layer 62. The elastic layer 61 is formed by foaming heat-resistant rubber such as insulating silicone rubber or fluororubber on the core bar 60, and RTV silicone rubber having been treated with a primer to have adhesiveness is applied as an adhesive layer on the elastic layer 61. The release layer 62 covered or coated with a tube obtained by dispersing a conductive agent such as carbon for example in PFA, PTFE, or FEP is formed on the elastic layer 61 through the adhesion layer. According to the first embodiment, the outer diameter of the pressure roller 52 is 18 mm, and the roller hardness of the pressure roller 52 is 48° (Asker-C with a weight of 600 g).

The pressure roller 52 is pressurized with 180 N by pressurizing means (not shown) from both longitudinal ends in order to form a nip part necessary for thermal fixing. The pressure roller 52 is driven to rotate in the direction of the arrow R1 (counterclockwise) in FIG. 3 by rotation driving (not shown) from the longitudinal end through the core bar 60. In this way, the fixing film 64 is moved to rotate at the outer side of the heater holder 65 in the direction of the arrow R2 (clockwise) in FIG. 3.

Heater Holder

The heater holder 65 holds the heater 63 and is made for example of a liquid crystal polymer, a phenolic resin, PPS, or PEEK. The fixing film 64 is externally fitted to the heater holder 65 with a margin, and the fixing film 64 is rotatably disposed. A liquid crystal polymer having a heat resistance of 260° C. and a thermal expansion coefficient of $6.4\times10^{-5}$/° C. is used for the heater holder 65 according to the first embodiment.

The recording medium 11 passes through the pressure contact nip part N formed between the pressure roller 52 and the fixing film 64. Heat supplied from the heater 63 heats the recording medium 11 through the fixing film 64 at the pressure contact nip part N. The unfixed toner image t on the recording medium 11 is melted by the heat received from the heated fixing film 64 and the pressure at the pressure contact nip part N and fixed onto the recording medium 11.

According to a temperature control program stored in the ROM 312 or the RAM 313, the engine control unit 302 as the control means controls the temperature of the heater 63 at a predetermined target temperature on the basis of the temperature sensed by the thermistor 66 as the temperature sensing unit. As a control method, PID control including a proportional term, an integral term, and a derivative term is preferably used. The PID control determines the energizing period of the heater 63 within a period and drives a heater energization period control circuit, which is not shown, so that the output power of the heater 63 is determined. According to the first embodiment, the output power of the heater 63 is updated at control period intervals of 100 milliseconds.

The engine control unit 302 or the target temperature control unit 350 determines, sets, or changes the target temperature on the basis of information from the image processing unit 303 which will be described. The engine control unit 302 or the target temperature control unit 320 issues an instruction to the fixing control unit 320 on the basis of the target temperature. In addition to the information from the image processing unit 303 which will be described, the engine control unit 302 or the target temperature control unit 350 may correct the target temperature by various kinds of correction, which have been performed conventionally, to the heated degree of the fixing unit 50, the ambient temperature and humidity, the printing mode, and the type of the recording material.

Figure 4:
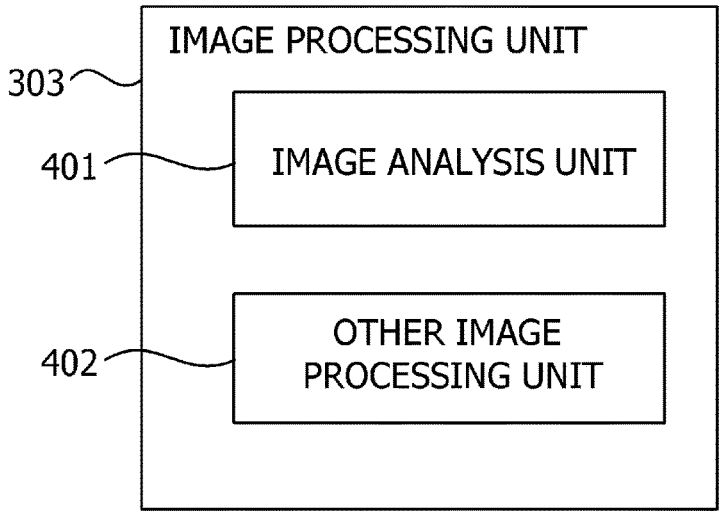
FIG. 4 is a view of an exemplary functional part of an image processing unit according to the first embodiment.

FIG. 4 is a diagram illustrating an exemplary functional portion of the image processing unit 303. The image processing unit 303 includes an image analysis unit 401 as image analysis means and the other image processing unit 402. As will be described, the image analysis unit 401 calculates a necessary target temperature for an image to be printed or a fixing temperature correlation value correlated with the necessary target temperature. The other image processing unit 402 performs image conversion or halftoning processing of a character code to form the image into a bit map.

In the color image forming apparatus according to the first embodiment, the other image processing unit 402 performs processing with a resolution of 600 dpi. The other image processing unit 402 may perform processing with any other resolution. The image analysis unit 401 performs calculation processing to image data processed by the other image processing unit 402. However, the order of the image processing is not limited to this order, and the calculation processing can be performed on the image data before the processing by the other image processing unit 402 is performed.

The target temperature necessary for the image to be printed depends on the toner height and print ratio. Furthermore, even with the same toner height and print ratio, the necessary target temperature changes depending on whether the image is continuous like a solid image or discrete like a character image, and character images are generally easily fixed. This is because the fixability of a discrete toner image is improved by heat coming from the region without the toner image in the periphery. Therefore, according to a conventional method, the target temperature is determined on the basis of character information obtained from PDL data or the number of consecutive pixels.

However, PDL data cannot be obtained depending on the type of a host computer or a job, and the fixing temperature may be overestimated when an object other than a character object is included. When the target temperature is controlled on the basis of the size of consecutive pixels, the consecutive number in an image such as a ruled line is calculated to be large, and the target temperature may be overestimated. When the target temperature is overestimated, more heat than necessary is supplied, which results in increased power consumption.

Therefore, according to the first embodiment, the target temperature is calculated from how pixels with a density equal to or higher than a predetermined value are arranged consecutively (continuity) in a predetermined region of image data and the percentage of the predetermined region occupied by pixels with a density equal to or higher than a predetermined value (coverage ratio). In this way, the target temperature can be calculated more accurately, and the power consumption may be reduced while securing necessary fixability.

Figure 5:
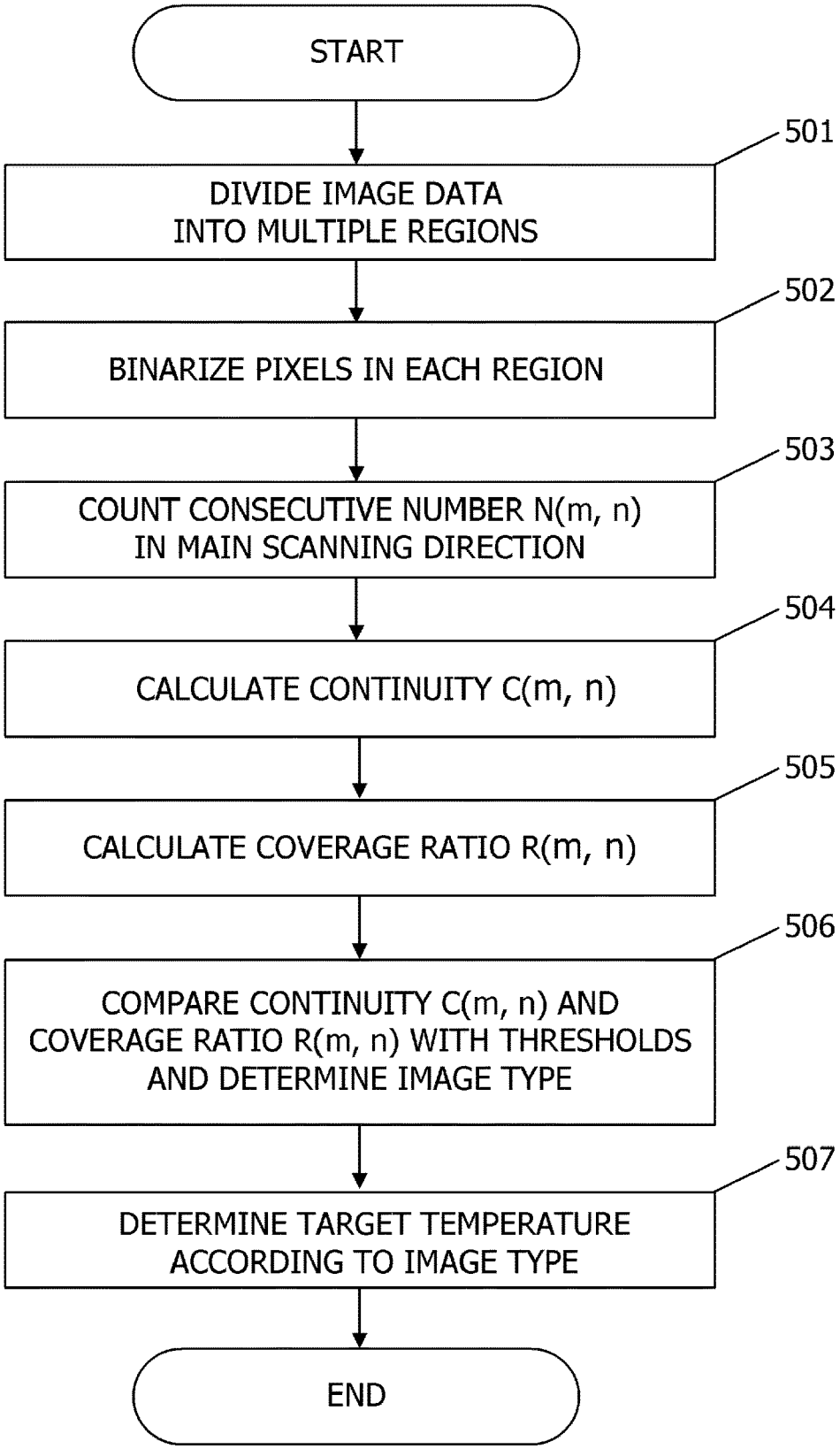
FIG. 5 is a flowchart for illustrating processing according to the first embodiment.
Figure 6:
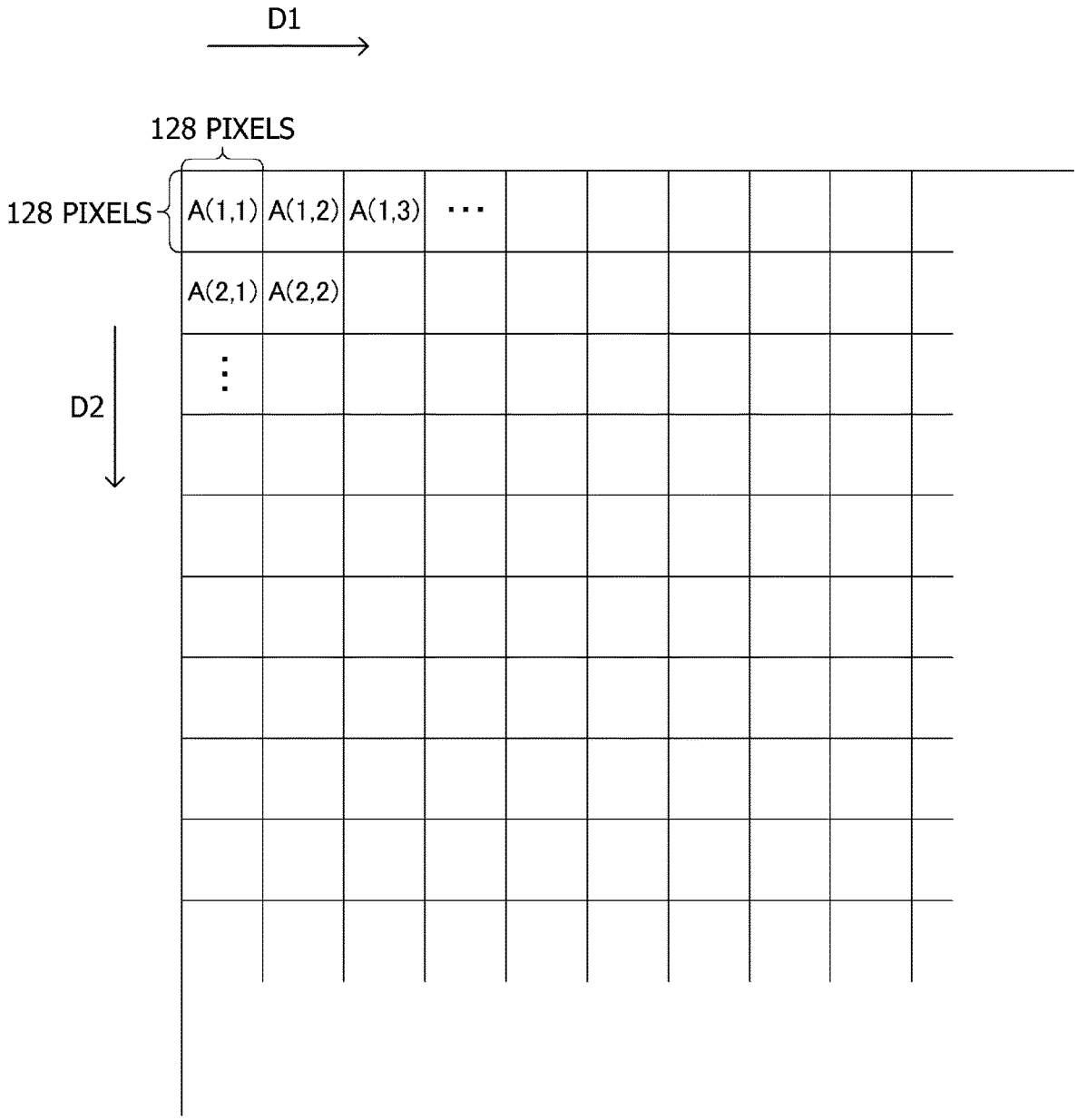
FIG. 6 is a view for illustrating processing for dividing image data according to the first embodiment.

With reference to FIGS. 5, 6, and 7, the method for determining (calculating) the target temperature (necessary temperature for fixing) will be described in detail. FIG. 5 is a flowchart for illustrating how to determine the target temperature according to the first embodiment. Hereinafter, an example of the processing for printing image data for one page sent from the host computer 300 to the color image forming apparatus on one recording medium 11 will be described.

As shown in FIG. 6, in step 501, the image analysis unit 401 divides the image data (600 dpi) into square regions each including 128 pixels in the main scanning direction (in the transverse direction or the direction of the arrow DO and 128 pixels in the sub-scanning direction (in the vertical direction or the direction of the arrow D2). The image analysis unit 401 divides the image data into a plurality of regions each including a plurality of pixels. The size of the regions obtained by dividing is preferably about from 10 to 2,000 pixels. If the region is too small, a character may be recognized as a sold image, while if the region is too large and includes both a character and a solid image, the character and the solid image may not be recognized correctly. According to the first embodiment, the region is square-shaped, while the region may have a different shape (predetermined shape) such as a rectangle. The main scanning direction coincides with the direction orthogonal to the direction in which the recording medium 11 is transported. The sub-scanning direction coincides with the direction in which the recording medium 11 is transported.

As shown in FIG. 6, A(m, n) is assigned to each of the plurality of regions, m in the parentheses is the number in the longitudinal direction (sub-scanning direction) of the region A, and n in the parentheses is the number in the transverse direction (main scanning direction). In the parentheses, m is the number counted from the front end of the recording medium 11, and n in the parentheses is the number counted from the left end of the recording medium 11, both of which are positive integers of one or more. When the total number of pixels in each region is Pa, Pa=128×128=16,384 holds according to the first embodiment.

In step 502, the image analysis unit 401 binarizes the pixels included in each region into "0" and "1", and assigns "0" or "1" to the pixels included in the region. According to the first embodiment, pixels with a density value (density data level) of 0, in other words, white pixels are binarized into 0, and non-white pixels are binarized into 1. In this way, the threshold for binarizing the pixels is 0 but may be a different value. Pixels in each region may be classified using two or more thresholds instead of binarization with one threshold.

Figure 7B:
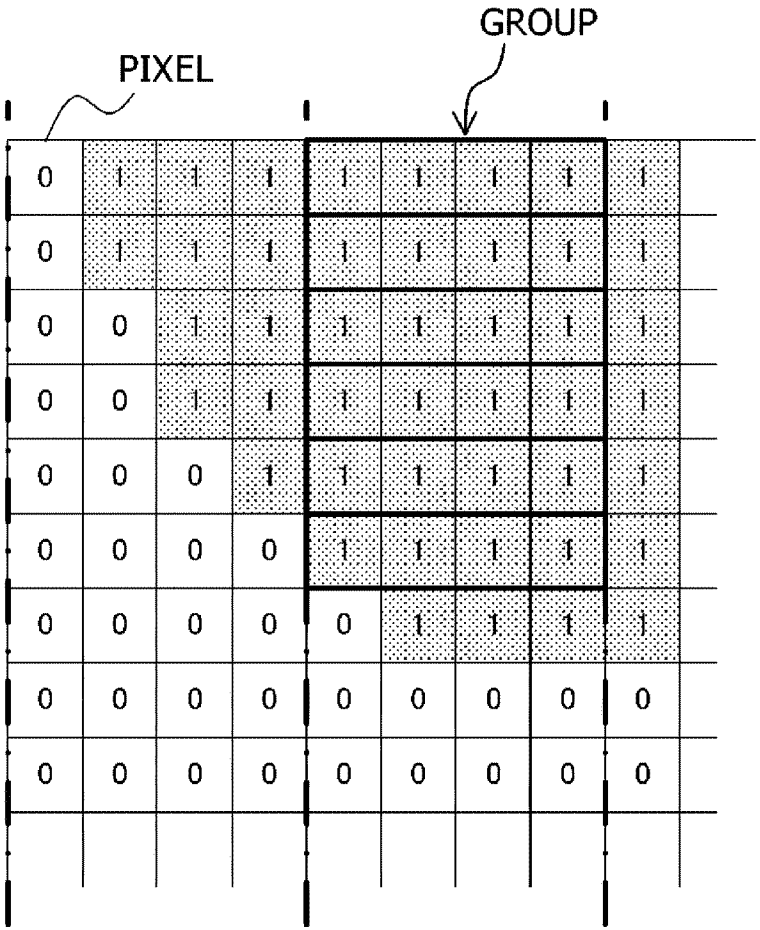
FIGS. 7A and 7B are views for illustrating consecutive number counting processing according to the first embodiment.
Figure 7A:
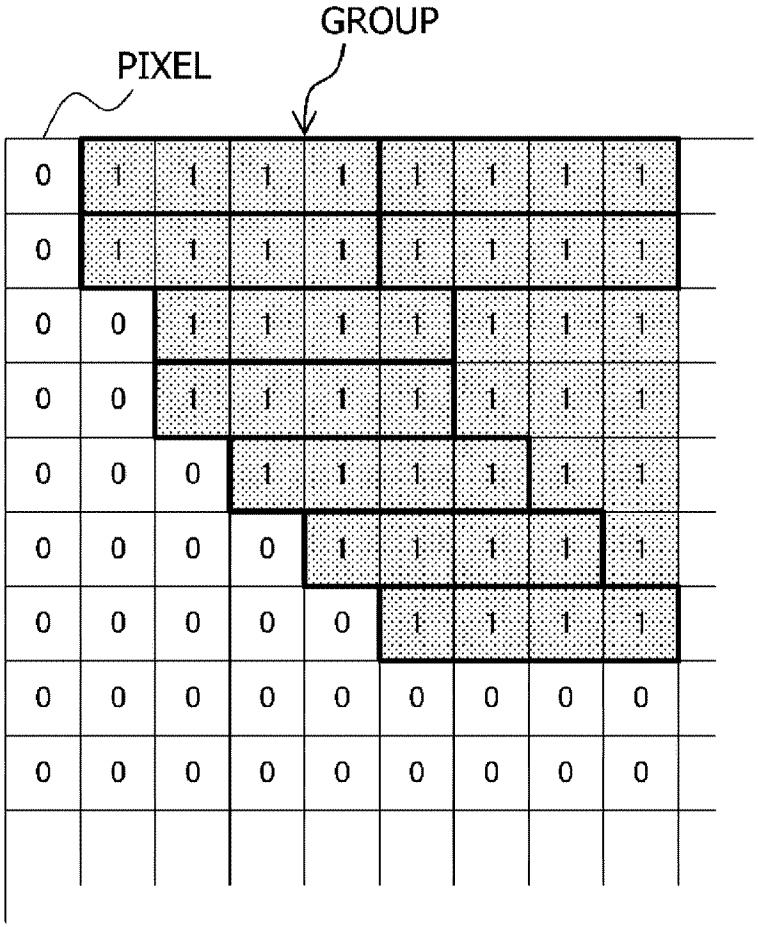

In step 503, as illustrated in FIG. 7A, the image analysis unit 401 counts the number N(m, n) of arrangements of four consecutive pixels having a binary value of 1 in the main scanning direction (hereinafter also referred to as the consecutive number) in each region. Stated differently, the image analysis unit 401 counts, for each region, the number of groups consisting of four consecutive pixels (pixels assigned with "1") arranged in the main scanning direction. The number of pixels having a binary value of 1 and arranged consecutively (consecutive number of pixels) is preferably a predetermined number from 3 to 30. If an image to be determined is too small (if the number of pixels is too small), it may be difficult to determine whether the image is a character image and a solid image. If an image to be determined is too large (if the number of pixels is too large), a character with a large line width, which is difficult to be fixed, may be included in the image to be determined. The consecutive number counting method may allow whether pixels are consecutive within a range separated in the main scanning direction as shown in FIG. 7B to be determined, and the method may be selected for example for convenience of processing.

In step 504, the image analysis unit 401 calculates continuity C(m, n) from the fraction where the consecutive number N(m, n) counted in step 503×4 is the numerator and the number of pixels P(m, n) having a binary value of 1 in the region is the denominator. The image analysis unit 401 calculates the continuity C(m, n) for each region.

If P (m, n)=0, then C(m, n)=0. Continuity C(m, n) is a value in the range from 0 to 1.

C(m, n)=N(m, n)×4/P(m, n).

Stated differently, the continuity C(m, n) is a value (first ratio) obtained by dividing the total number of pixels included in a plurality of groups consisting of pixels having a binary value of 1 and arranged consecutively in a predetermined direction in a predetermined region by the total number of pixels having a binary value of 1 in the predetermined region. In this way, the continuity C(m, n) is a value (first ratio) obtained by dividing the total number of pixels having a binary value of 1 and arranged consecutively in the predetermined direction in the predetermined region by the total number of pixels having a binary number of 1 in the region. The predetermined direction is the main scanning direction. A pixel with a binary value of 1 has a density equal to or higher than a predetermined value. The predetermined value is, for example, a density value other than 0.

In step 505, the image analysis unit 401 calculates a coverage ratio R(m, n) from the fraction where the number of pixels P(m, n) having a binary value of 1 in the region is the numerator and the number of all the pixels Pa in the region as the denominator. The image analysis unit 401 calculates the coverage ratio R(m, n) for each of the regions. The coverage ratio R(m, n) is a value in the range from 0 to 1.

R(m, n)=P(m, n)/Pa

Stated differently, the coverage ratio R(m, n) is a value (second ratio) obtained by dividing the total number of pixels having a binary value of 1 in a predetermined region by the total number of pixels in the predetermined region.

In step 506, the image analysis unit 401 compares the continuity C(m, n) with a continuity threshold Cth for each region and compares the coverage ratio R(m, n) with a coverage ratio threshold Rth. The image analysis unit 401 determines whether the continuity C(m, n) in the predetermined region is less than the continuity threshold Cth (first threshold). The image analysis unit 401 determines whether the coverage ratio R(m, n) in the predetermined region is less than a coverage ratio threshold Rth (second threshold). The image analysis unit 401 is an exemplary second determining portion. When the continuity C(m, n) in the predetermined region is less than the continuity threshold Cth (first threshold) and the coverage ratio R(m, n) in the predetermined region is less than the coverage ratio threshold Rth (second threshold), the image analysis unit 401 determines the type of the predetermined region as an image type 1. More specifically, when the continuity C(m, n) and the coverage ratio R(m, n) in the predetermined region are both less than the thresholds, the image analysis unit 401 determines the type of the predetermined region as the image type 1. When the continuity C(m, n) in the predetermined region is equal to or more than the continuity threshold Cth, or when the coverage ratio R(m, n) in the predetermined region is equal to or more than the coverage ratio threshold Rth, the image analysis unit 401 determines the type of the predetermined region as an image type 2. More specifically, when at least one of the continuity C(m, n) and the coverage ratio R(m, n) in the predetermined region is equal to or more than the corresponding threshold, the image analysis unit 401 determines the type of the predetermined region as the image type 2. According to the first embodiment, while the continuity threshold Cth is 0.8, and the coverage ratio threshold Rth is 0.25, the continuity threshold Cth and the coverage ratio threshold Rth may be other values.

In step 507, when all the images in the plurality of regions within the page belong to image type 1 (hereinafter in a first condition), the target temperature control unit 350 determines a temperature lower than a first predetermined temperature as a target temperature. The first predetermined temperature is a target temperature (high) determined when the image of at least one region within the page belongs to the image type 2. More specifically, in the first condition, the target temperature control unit 350 determines the target temperature lower than the target temperature (high) when the image of at least one region in the page belongs to the image type 2.

In the first condition, the target temperature control unit 350 may determine a first temperature previously stored in a memory (storage unit) such as the ROM 312 and the RAM 313 as the target temperature. The first temperature may be, for example, the lowest temperature at which the toner image can be fixed to the recording medium 11 when the images of all the regions within the page belong to the image type 1. The first temperature may be lower than a first reference temperature previously stored in a memory (storage unit) such as the ROM 312 and the RAM 313. The first reference temperature may be, for example, a temperature at which the toner image can be fixed to the recording medium 11 when the image pattern that is the most difficult to fix is included in the image data.

Meanwhile, in step 507, when the image of at least one of the plurality of regions in the page belongs to the image type 2 (hereinafter, in a second condition), the target temperature control unit 350 determines a temperature higher than a second predetermined temperature as the target temperature. The second predetermined temperature is a target temperature (low) determined when all the images of the plurality of regions within the page belong to the image type 1. More specifically, in the second condition, the target temperature control unit 350 determines the target temperature higher than the target temperature (low) when all images of the plurality of areas in the page are the image type 1.

In the second condition, the target temperature control unit 350 may determine a second temperature previously stored in a memory (storage unit) such as the ROM 312 and the RAM 313 as the target temperature. The second temperature may be, for example, the temperature at which the toner image can be fixed to the recording medium 11 when the image pattern that is the most difficult to fix is included in the image data. The second temperature may be higher than a second reference temperature previously stored in a memory (storage unit) such as the ROM 312 and the RAM 313. The second reference temperature may be, for example, the temperature at which the toner image can be fixed to the recording medium 11 when an image pattern that is easy to fix to is included in the image data.

In step 503 described above, the image analysis unit 401 counts the number N(m, n) of arrangements of four consecutive pixels having a binary value of 1 in the main scanning direction in each region. Alternatively, the image analysis unit 401 may count the number N(m, n) of arrangements of four consecutive pixels having a binary value of 1 in the sub-scanning direction in each region. Stated differently, the image analysis unit 401 may count the number of groups consisting of four consecutive pixels (pixels assigned with "1") arranged in the sub-scanning direction for each region. Even in this case, the number of pixels (consecutive number of pixels) having a binary value of 1 and arranged consecutively is preferably about a number from 3 to 30.

When the processing is modified as described above, the image analysis unit 401 calculates the continuity C(m, n) from the fraction where the consecutive number N(m, n) counted as described above×4 is the numerator, and the number of pixels P(m, n) having a binary value of 1 is the denominator. The image analysis unit 401 calculates the continuity C(m, n) for each region.

In this case, the continuity C(m, n) is a value (first ratio) obtained by dividing the total number of pixels included in the plurality of groups consisting of pixels having a binary value of 1 and arranged consecutively in the sub-scanning direction in a predetermined region by the total number of pixels having a binary value of 1 in the predetermined region.

In the above example, the number of consecutively arranged pixels having a binary value of 1 is the same among the groups. Alternatively, the number of consecutively arranged pixels having a binary value of 1 may be the same among some of the plurality of groups or may be the same among others of the plurality of groups. In addition, the number of consecutively arranged pixels with a binary value of 1 may be any number in each group.

Steps 503 and 504 may be modified as follows. In step 503, the image analysis unit 401 counts the number (consecutive number) N1(m, n) of arrangements of three consecutive pixels having a binary value of 1 in the main scanning direction in each region. Stated differently, the image analysis unit 401 counts the number of groups consisting of three consecutive pixels (pixels assigned with "1") in the main scanning direction for each region. In step 503, the image analysis unit 401 counts the number N2(m, n) (consecutive number) of arrangements of four consecutive pixels having a binary value of 1 in the main scanning direction in each region. Stated differently, the image analysis unit 401 counts the number of groups consisting of four consecutive pixels (pixels assigned with "1") in the main scanning direction for each region.

The image analysis unit 401 may count the number N1(m, n) of arrangements of three consecutive pixels having a binary value of 1 in the sub-scanning direction in each region. The image analysis unit 401 may count the number N2(m, n) of arrangements of four consecutive pixels having a binary value of 1 in the sub-scanning direction in each region.

In step 504, the image analysis unit 401 calculates the continuity C(m, n) from the fraction where the sum of the consecutive number N1(m, n) counted in step 503×3 and the consecutive number N2(m, n)×4 is the numerator and the number of pixels P(m, n) having a binary value of 1 in the region is the denominator. The image analysis unit 401 calculates the continuity C(m, n) for each region.

If P(m, n)=0, then C(m, n)=0.

The continuity C(m, n) is a value from 0 to 1.

$$C(m, n)=(N1(m, n)\times 3+N2(m, n)\times 4)/P(m, n)$$

The processing for determining an image type on the basis of continuity and a coverage ratio according to the first embodiment will be described with reference to FIG. 8. For the sake of simplicity of description, an example of a K single-color toner image will be described here.

The image type 1 in FIG. 8 corresponds to a discrete, low coverage ratio, and easy-to-fix image, such as a character image. The image type 2 in FIG. 8 corresponds to an image which is continuous and difficult to fix, such as a solid image. Hereinafter, first to fourth images in FIG. 8 will be described. The first image includes a 10.5 point MSP Gothic letter. The continuity C and the coverage ratio R of the first image are both below the respective thresholds (threshold comparison: NO). Therefore, the first image is determined as the image type 1. The second image, in contrast, is an image which includes a part of a 72-point MSP Gothic letter. The continuity C and the coverage ratio R of the second image both exceed the respective thresholds (threshold comparison: YES). Therefore, the second image is determined as the image type 2. As can be understood, it is appropriately determined that a large point letter has a large line width, and it is difficult to fix the second image. The third image is a fully solid image. The continuity C and the coverage ratio R of the third image are both 1 and exceed the thresholds. Therefore, the third image is determined as the image type 2. The fourth image is an image that includes a checkered pattern, and the continuity C of the fourth image is 0 and below the threshold. Meanwhile, the coverage ratio R of the fourth image is 0.5 which is equal to or higher than the threshold. Therefore, the fourth image is determined as the image type 2. It is more difficult to fix the image including such a discrete but high coverage ratio pattern than an image such as a letter. According to the first embodiment, it can be appropriately determined whether it is easy or difficult to fix the image.

If all the regions in the page of the image data are determined as the image type 1, it can be determined that the page can be fixed at a low temperature, so that a target temperature lower than a normal target temperature is determined. At the normal target temperature, even the image pattern that is the most difficult to fix can be fixed, and the normal target temperature is set when a solid image with the maximum laid-on amount is on the entire surface of the recording medium 11 and is 205° C. according to the first embodiment. Meanwhile, when the images of all regions within the page belong to the image type 1, 185° C. which is 20° C. lower than the normal target temperature is determined as the target temperature.

An example of the processing by the image analysis unit 401 and the target temperature control unit 350 according to the first embodiment will be described. The image analysis unit 401 divides image data into a plurality of regions each including a plurality of pixels. The image analysis unit 401 is an example of a processing portion. The image analysis unit 401 obtains, for each of the plurality of regions, a first ratio by dividing a total number of pixels having a density equal to or higher than a predetermined value and arranged consecutively in a predetermined direction by a total number of pixels having a density equal to or higher than the predetermined value included in each region. The image analysis unit 401 is an example of a first obtaining portion. The image analysis unit 401 obtains, for each of the plurality of regions, a second ratio by dividing a total number of pixels having a density equal to or higher than a predetermined value included in each region by a total number of pixels included in each region. The image analysis unit 401 is an example of a second obtaining portion. The target temperature control unit 350 determines a target temperature on the basis of the first ratio and the second ratio. The target temperature control unit 350 is an example of a first determining portion.

As described above, according to the first embodiment, a target temperature for fixing a recording material is determined according to the continuity on the basis of the continuous property of how pixels having a density equal to or higher than a predetermined value are arranged consecutively in the main scanning direction in a predetermined region and the coverage ratio on the basis of the ratio of pixels having a density equal to or higher than a predetermined value in the predetermined region. In this way, an optimum target temperature for the image can be determined, so that the power consumption can be reduced.

Second Embodiment

A second embodiment will be described with reference to FIGS. 9 and 10.

The second embodiment is different from the first embodiment in that continuity is calculated for both the main scanning direction and the sub-scanning direction. Note that most of the configuration and operation of the color image forming apparatus are the same as those according to the first embodiment described above. Therefore, in the following, features different from the first embodiment will be described and the elements according to the second embodiment identical to those according to the first embodiment will be denoted by the same reference characters as the first embodiment, and the description thereof will not be repeated.

Figure 9:
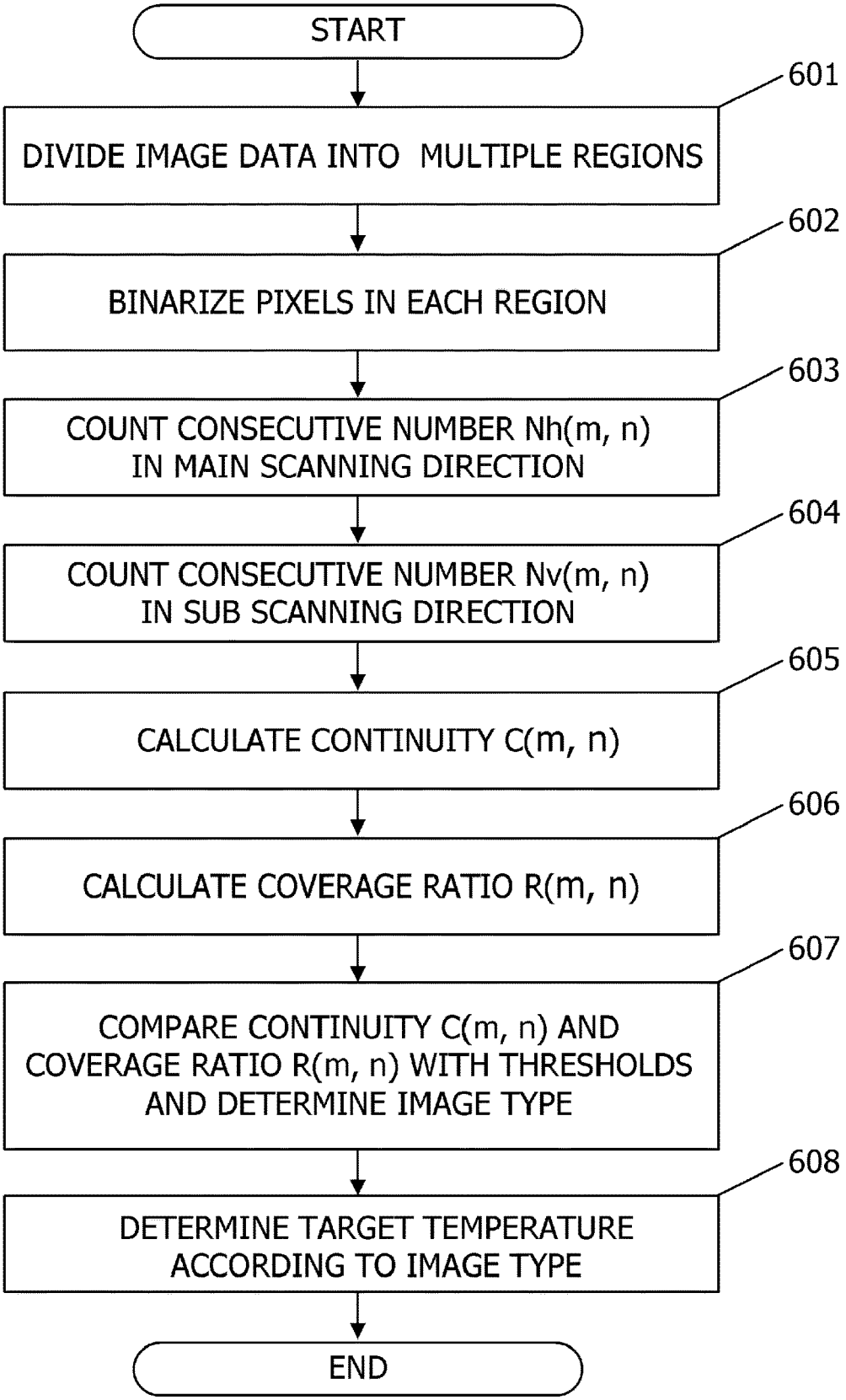
FIG. 9 is a flowchart for illustrating processing according to a second embodiment.

FIG. 9 is a flowchart for illustrating a method for determining a target temperature according to the second embodiment. According to the flowchart in FIG. 9, the method will be described step by step in detail. According to exemplary processing in the following, image data for one page sent from the host computer 300 to the color image forming apparatus is printed on one recording medium 11.

Steps 601 and 602 in the flowchart in FIG. 9 are identical to steps 501 and 502 in the flowchart according to the first embodiment shown in FIG. 6, and therefore the steps will not be described.

In step 603, the image analysis unit 401 counts the number Nh(m, n) of arrangements of four consecutive pixels having a binary value of 1 in the main scanning direction in each region. Stated differently, for each region, the image analysis unit 401 counts the number of groups consisting of four consecutive pixels (pixels assigned with "1") in the main scanning direction.

In step 604, the image analysis unit 401 counts the number Nv(m, n) of arrangements of four consecutive pixels having a binary value of 1 in the sub-scanning direction in each region. Stated differently, the image analysis unit 401 counts the number of groups consisting of four consecutive pixels (pixels assigned with "1") in the sub-scanning direction for each region.

In step 605, the image analysis unit 401 calculates continuity C2(m, n) from the fraction where (Nh+Nv)×4 is the numerator, and the number of pixels P(m, n) having a binary value of 1 in the region is the denominator.

If P(m, n)=0, then C2(m, n)=0.

The continuity C2(m, n) is a value from 0 to 2.

$$C2(m, n)=(Nh(m, n)+Nv(m, n)\times 4/P(m, n)$$

Stated differently, the continuity C(m, n) is a value (first ratio) obtained by dividing the total number of pixels included in a plurality of groups of pixels arranged consecutively in a predetermined direction in a predetermined region by the total number of pixels having a binary value of 1 in the region. The predetermined directions according to the second embodiment are the main scanning direction and the sub-scanning direction. A pixel having a binary value of 1 has a density equal to or higher than a predetermined value. The predetermined value is for example a density value other than 0. The plurality of groups includes a first group consisting of pixels having a density equal to or higher than a predetermined value and arranged consecutively in the main scanning direction, and a second group consisting of pixels having a density equal to or higher than the predetermined value and arranged consecutively in the sub-scanning direction.

In step 606, the image analysis unit 401 calculates a coverage ratio R(m, n) from the fraction where the number of pixels P(m, n) having a binary value of 1 in the region is the numerator and the number of all the pixels Pa in the region is the denominator. The image analysis unit 401 calculates the coverage ratio R(m, n) for each region. The coverage ratio R(m, n) is a value from 0 to 1.

R(m, n)=P(m, n)/Pa

Stated differently, the coverage ratio R(m, n) is a value (second ratio) obtained by dividing the total number of pixels having a binary value of 1 in the predetermined region by the total number of pixels in the predetermined region.

In step 607, the image analysis unit 401 compares, for each region, the continuity C2 (m, n) with a continuity threshold Cth2 and the coverage ratio R(m, n) with a coverage ratio threshold Rth. The image analysis unit 401 determines whether the continuity C2(m, n) in the predetermined region is less than the continuity threshold Cth2 (first threshold). The image analysis unit 401 determines whether the coverage ratio R(m, n) in the predetermined region is less than the coverage ratio threshold Rth (second threshold). When the continuity C2(m, n) in the predetermined region is less than the continuity threshold Cth2 and the coverage ratio R(m, n) in the predetermined region is less than the coverage ratio threshold Rth, the image analysis unit 401 determines the type in the predetermined region as the image type 1. More specifically, when both the continuity C2(m, n) and the coverage ratio R (m, n) in the predetermined region are less than the respective thresholds, the image analysis unit 401 determines the type of the predetermined region as the image type 1. When the continuity C2(m, n) in the predetermined region is equal to or more than the continuity threshold Cth2, or when the coverage ratio R(m, n) in the predetermined region is equal to or more than the coverage ratio threshold Rth, the image analysis unit 401 determines the type of the predetermined region as the image type 2. More specifically, when at least one of the continuity C2(m, n) and the coverage ratio R (m, n) in the predetermined region is equal to or more than the corresponding threshold, the image analysis unit 401 determines the type of the predetermined region as the image type 2. According to the second embodiment, while the continuity threshold Cth2 is 1.6, and the coverage ratio threshold Rth is 0.25, the continuity threshold Cth2 and the coverage ratio threshold Rth may be other values.

In step 608, when all the images in the plurality of regions in the page belong to the image type 1 (hereinafter in the first condition), the target temperature control unit 350 determines a temperature lower than a first predetermined temperature as the target temperature. The first predetermined temperature is a target temperature (high) determined when the type of an image in at least one region in the page is the image type 2. More specifically, in the first condition, the target temperature control unit 350 determines a target temperature lower than the target temperature (high) when the type of an image in at least one region in the page is the image type 2.

In the first condition, the target temperature control unit 350 may determine a first temperature previously stored in a memory (storage unit) such as the ROM 312 and the RAM 313 as the target temperature. The first temperature may be for example the minimum temperature at which a toner image can be fixed to the recording medium 11 when the types of the images in all regions in the page are the image type 1. The first temperature may be lower than a first reference temperature previously stored in a memory (storage unit) such as the ROM 312 and the RAM 313. The first reference temperature may be for example a temperature at which a toner image can be fixed to the recording medium 11 when an image pattern that is the most difficult to be fixed is included in the image data.

Meanwhile, in step 608, when the type of an image in at least one region of the plurality of regions in the page is the image type 2 (hereinafter in the second condition), the target temperature control unit 350 determines a temperature higher than a second predetermined temperature as the target temperature. The second predetermined temperature is a target temperature (low) determined when the types of all the images in the plurality of regions in the page are the image type 1. More specifically, in the second condition, the target temperature control unit 350 determines a target temperature higher than the target temperature (low) when all images of the plurality of regions in the page belong to image type 1.

In the second condition, the target temperature control unit 350 may determine a second temperature previously stored in a memory (storage unit) such as the ROM 312 and the RAM 313 as the target temperature. The second temperature may be for example a temperature at which a toner image can be fixed to the recording medium 11 when the image pattern that is the most difficult to be fixed is included in the image data. The second temperature may be higher than the second reference temperature previously stored in a memory (storage unit) such as the ROM 312 and the RAM 313. The second reference temperature may be for example a temperature at which the toner image can be fixed to the recording medium 11 when the image data includes an image pattern which is easy to be fixed.

In the above description, the number of consecutively arranged pixels having a binary value of 1 is the same among the groups. Alternatively, the number of consecutively arranged pixels having a binary value of 1 may be the same number among some of the plurality of groups and may be the same number among others of the plurality of groups. The number of consecutively arranged pixels having a binary value of 1 in each group may be any number.

The above steps 603 to 605 may be modified as follows. In step 603, the image analysis unit 401 counts the number Nh1(m, n) of arrangements of three consecutive pixels having a binary value of 1 in the main scanning direction in each region. Stated differently, the image analysis unit 401 counts the number of groups consisting of three consecutive pixels (pixels assigned with "1") in the main scanning direction for each region. In step 603, the image analysis unit 401 counts the number Nh2(m, n) of arrangements of four consecutive pixels having a binary value of 1 in the main scanning direction for each region. Stated differently, for each region, the image analysis unit 401 counts the number of groups consisting of four consecutively arranged pixels (pixels assigned with "1") in the main scanning direction.

In step 604, the image analysis unit 401 counts the number Nv1(m, n) of arrangements of three consecutive pixels having a binary value of 1 in the sub-scanning direction in each region. Stated differently, the image analysis unit 401 counts the number of groups consisting of three consecutive pixels (pixels assigned with "1") in the sub-scanning direction for each region. In step 604, the image analysis unit 401 counts the number Nv2(m, n) of arrangements of four consecutive pixels having a binary value of 1 in the sub-scanning direction for each region. Stated differently, the image analysis unit 401 counts the number of groups consisting of four consecutive pixels (pixels assigned with "1") in the sub-scanning direction for each region.

In step 605, the image analysis unit 401 calculates the continuity C2(m, n) from the fraction where the sum of (Nh1+Nv1)×3 and (Nh2+Nv2)×4 is the numerator and the number of pixels P(m, n) having a binary value of 1 in the region as the denominator.

If P(m, n)=0, then C2(m, n)=0.

The continuity C2(m, n) is a value from 0 to 2.

C2(m, n)=((Nh1(m, n)+Nv1(m, n))×3+(Nh2(m, n)+Nv2(m, n))×4)/P(m, n)

According to the second embodiment, the continuity is calculated for both the main scanning direction and the sub-scanning direction and therefore the continuity can be more appropriately obtained. FIG. 10 shows the difference in the calculation result between the first and second embodiments. The results obtained for the first to fourth images in FIG. 10 are the same as those according to the first embodiment. In the image of the horizontal line shown in the fifth image in FIG. 10, it is determined by the image determining method according to the first embodiment that the continuity C is equal to or more than the threshold Cth, and therefore the type of the fifth image is determined as the image type 2. In contrast, in the fifth image, the continuity in the main scanning direction is high, but the continuity in the sub-scanning direction is low. Therefore, by the image determining method according to the second embodiment, the continuity C2 is below the threshold Cth2 and the type of the fifth image is determined as the image type 1. As for actual fixability, it is easy to fix an image with a thin line similarly to an image with a letter. An image having a large width or having multiple lines which result in a high coverage is difficult to be fixed.

As described above, by the image determining method according to the second embodiment, a lower target temperature than the first embodiment can be determined by more appropriately determining the image type, so that the power consumption can be reduced. Meanwhile, the consecutive time is counted for both the main scanning direction and the sub-scanning direction, the load on the image processing unit 303 increases, and therefore whether to use the image determining method may be determined in consideration of this aspect.

Third Embodiment

The third embodiment will be described with reference to FIGS. 11 and 12.

According to the third embodiment, a method for determining a target temperature on the basis of a result of image type determination is different from those according to the first and second embodiments. According to the first and second embodiments, a low target temperature is determined when the types of all the regions in the page of an image data are the image type 1. In contrast, according to the third embodiment, the number of pixels in image regions determined as the image type 2 is added up and a target temperature is determined on the basis of the result. Note that most of the configuration and operation of the color image forming apparatus are the same as those according to the first and second embodiments. Therefore, in the following, features different from the first and second embodiments will be described and the elements according to the third embodiment identical to those according to the first and second embodiments will be denoted by the same reference characters as the first and second embodiments, and the description thereof will not be repeated.

Figure 11:
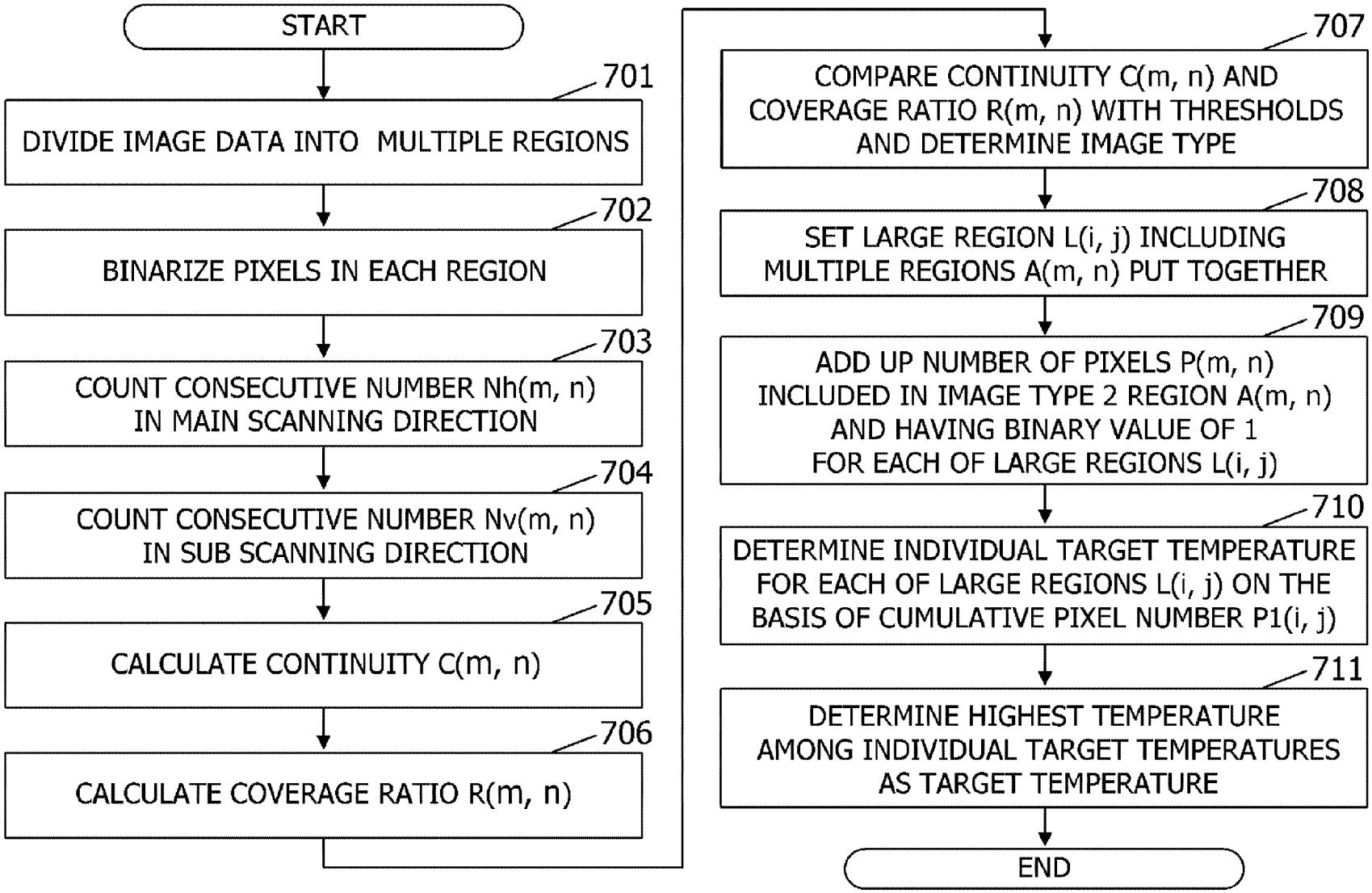
FIG. 11 is a flowchart for illustrating processing according to a third embodiment.

FIG. 11 is a flowchart for illustrating a method for determining a target temperature according to the third embodiment. According to the flowchart in FIG. 11, the method will be described in detail on a step-basis. However, since steps 701 to 707 in the flowchart related to the third embodiment are the same as steps 601 to 607 in the flowchart related to the second embodiment and will not be described.

Figure 12:
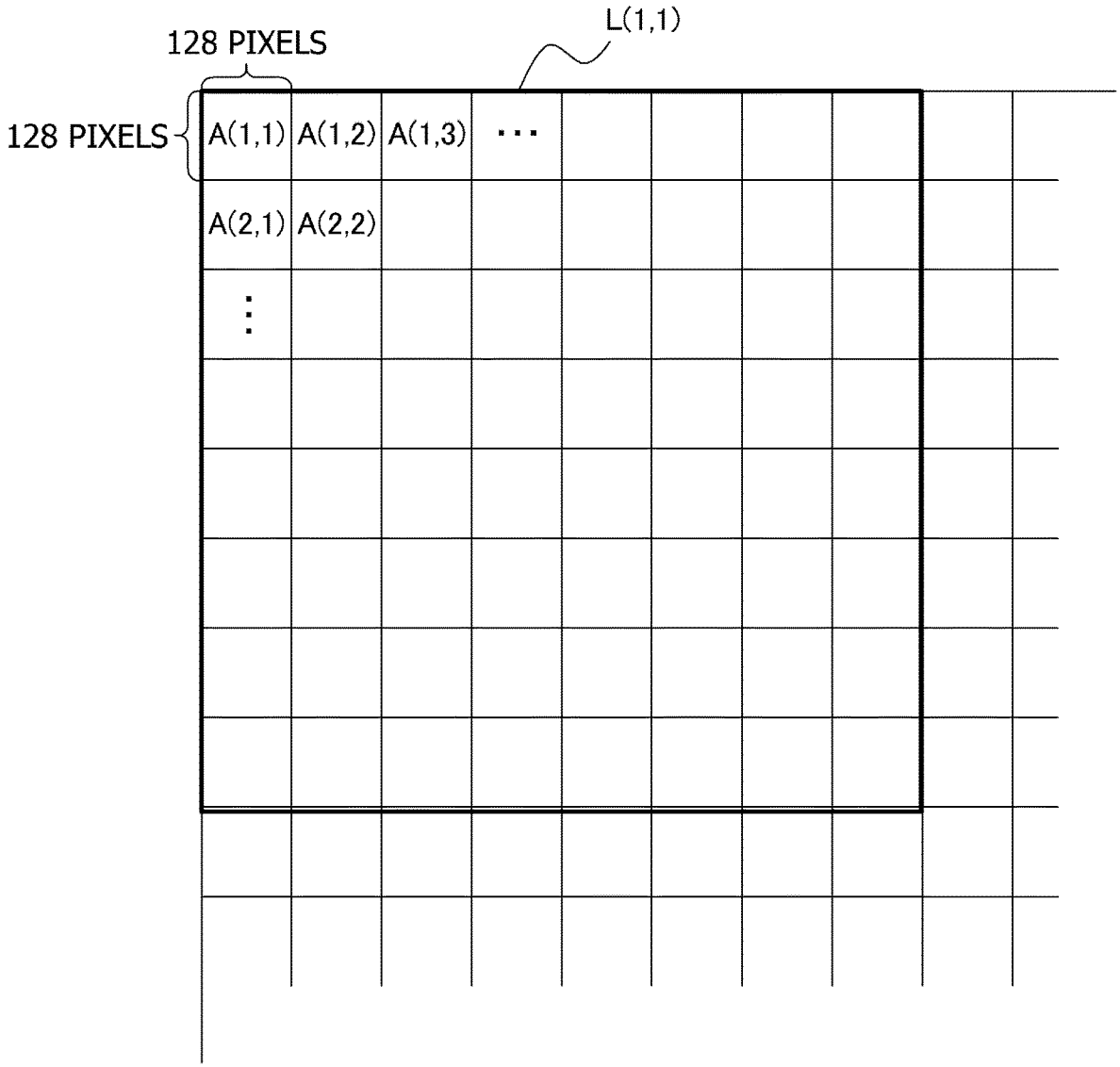
FIG. 12 is a view for illustrating how a large region L is divided according to third embodiment.

In step 708, as illustrated in FIG. 12, the image analysis unit 401 sets a large region L(i, j) including eight (in the main scanning direction) by eight (in the sub-scanning direction)=64 regions put together for a plurality of regions A(m, n) of image data. The regions A(m, n) may include 128 pixels (in the main scanning direction)×128 pixels (in the sub-scanning direction). The letter i in the parentheses represents the number in the large region L in the longitudinal direction (sub-scanning direction), and j in the parentheses represents the number in the transverse direction (main-scanning direction). The letter i in the parentheses represents the number counted from the front end of the recording medium 11, and j in the parentheses represents the number counted from the left end of the recording medium 11, both of which are positive integers of one or more. As shown in FIG. 12, the large region L(i, j) includes two or more connected regions of the multiple regions A (m, n) in the page.

In step 709, the image analysis unit 401 adds up the number of pixels P(m, n) having a binary value of 1 included in the regions A(m, n) of the image determined as the image type 2 in the regions A(m, n) of each large region L(i, j). Hereinafter, the added-up number of pixels P(m, n) will be referred to as the cumulative pixel number P1(i, j).

In step 710, the image analysis unit 401 refers to a translation table shown in Table 1 below and determines an individual target temperature for each large region L(i, j) on the basis of the cumulative pixel number P1(i, j).

TABLE 1

| Cumulative pixel number P1 | Target temperature (° C.) |
|---|---|
| 0 | 185 |
| 1 to 8,000 | 190 |
| 8,001 to 16,000 | 195 |
| 16,001 to 64,000 | 200 |
| 64,001 or more | 205 |

In step 711, the image analysis unit 401 determines, as a target temperature, the highest temperature among the individual target temperatures determined for each large region L(i, j) in the page of the image data.

According to the first and second embodiments, when image data includes at least one region of the image type 2 image, a high target temperature is determined. According to the third embodiment, when image data includes a region of the image of image type 2, the target temperature is determined according to the total number of pixels in the region of the image type 2. Even for a continuous image such as the image type 2, the fixability varies depending on the size of the image, and the image size increases, it is difficult to fix the image. According to the third embodiment, the size of a continuous image is reflected upon the target temperature, and the target temperature is determined in a detailed manner according to the image, so that the power consumption can be reduced.

For example, when a 5 mm×5 mm solid-patch image is included in image data, a target temperature of 205° C. is determined according to the first and second embodiments because the 5 mm×5 mm solid-patch image belongs to the image type 2. In contrast, according to the third embodiment, the number of pixels in the 5 mm×5 mm solid-patch image is approximately 14,000, and a target temperature of 195° C. is determined from Table 1.

The target temperature is determined for each large region L(i, j) because the target temperature may be too high when the number of pixels P(m, n) in the regions of the image type 2 is added up in one page. For example, if multiple solid-patch images of 5 mm×5 mm are present apart from one another within a page, and all pixels within the page are added up, the pixels of the multiple solid-patch images are summed. Therefore, the cumulative pixel number P1 increases, and the target temperature is determined to be higher than necessary. Regions A(m, n) included in a large region L(i, j) according to the third embodiment are 64 regions (eight regions in the main scanning direction×eight regions in the sub-scanning direction). The number of regions A(m, n) included in the large region L(i, j) may be other than 64 or the shape of the large region L (i, j) may be any other shape than the square. If the number of regions A(m, n) included in the large region L(i, j) is too small, it is difficult to determine the size of a continuous image. Meanwhile, if the number of regions A(m, n) in the large region L(i, j) is too large, the target temperature will be calculated to be high as the number of pixels is added up.

Since the fixability of an image type 1 image, which is a discrete image, does not vary significantly depending on the number of images, the pixel number of image type 1 is not reflected on the target temperature according to the third embodiment. However, depending on the characteristics of the image forming apparatus or the fixing apparatus, the image type 1 image may be reflected on the target temperature.

As described above, by the method according to the third embodiment, a target temperature lower than those according to the first and second embodiments may be determined by reflecting the cumulative number of pixels in the region of the image determined as the image type 2 on the target temperature. Therefore, the power consumption may be more reduced. Meanwhile, since the load on the image processing unit 303 increases by counting the cumulative number of pixels, which method to use should be determined in consideration of this aspect.

While the configurations of the color image forming apparatuses according to the first to third embodiments have been described, the configuration of the monochrome image forming apparatus may be used. While the configuration for heating using a ceramic heater has been described, a different heating configuration such as a halogen heater or an IH (induction heating) may be used. While in the foregoing, the host computer 300 is connected to a color image forming apparatus for printing by way of illustration, printing may be performed as a computer or a print server connected on a network instead of the host computer 300 may be connected.

The image analysis and determination of the target temperature correction amount are performed by the image processing unit 303 of the controller unit 301. Image analysis or calculation of a target temperature correction amount may be performed partly or entirely by the host computer 300, a printer on a network, and a program owned by a print server.

The target temperature may be changed on the basis of information such as a fixing mode, surrounding environmental information obtained by environmental detection means (not shown) or information from recording medium type determining means using a media sensor which is not shown.

In the fixing control, only the target temperature is changed, but the gain or offset power amount of the PID control used for target temperature control may be changed.

One target temperature is determined for each page, but as an optimum target temperature for each region in the transport direction such as the period of the fixing film may be determined, so that changing the target temperature within the page can be addressed. More specifically, the target temperature may be determined for each region in the sub-scanning direction in the page. The optimum target temperature can be determined for each region in the main scanning direction in the page, so that the result can be reflected on control of a heater divided in the longitudinal direction.

The image analysis unit 401 performs calculation processing to image data processed by the other image processing unit 402. However, the order of the image processing is not limited to this, and is not limited to this order, and the calculation processing can be performed on the image data before the processing by the other image processing unit 402 is performed.

Although pixels in the regions of the image data are binarized and processed by way of illustration in the above description, a plurality of density thresholds may be provided. In this case, the target temperature is determined according to a result of determination about the multiple density values and image types. When a translation table as in the third embodiment is used, a table for each of the plurality of density values is prepared, so that an optimum target temperature can be determined by combining a density value and an image type.

According to the first to third embodiments, a target temperature may be determined by calculating a correction value for a reference target temperature and correcting the reference target temperature with the correction value. A value correlated with the target temperature may be used instead of the correction value, or any of other values correlated with the fixability may be used.

As described above, according to the first to third embodiments, a target temperature for fixing a recording material is determined according to continuity on the basis of the continuous property of pixels having a density equal to or higher than a predetermined value in a predetermined region and a coverage ratio on the basis of the ratio of pixels having the density equal to or higher than the predetermined value in the predetermined region. In this way, for example a target temperature may be lowered for a discrete image like a character, and an optimum fixing temperature can be selected, so that the power consumption can be reduced.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-058977, filed on Mar. 26, 2019, which is hereby incorporated by reference herein in its entirety.

What is claimed is:

1. An image forming apparatus, comprising:

a fixing portion configured to fix a toner image formed in accordance with image data on a recording material;

a processing portion configured to divide the image data into a plurality of regions including a plurality of pixels;

a first obtaining portion configured to obtain, for each region of the plurality of regions, in a case each group of a plurality of group includes the plurality of pixels having a density equal to or higher than a predetermined value and arranged consecutively in a predetermined direction in the each region, a first ratio by dividing a total number of the pixels included in the plurality of groups by a total number of the pixels having the density equal to or higher than the predetermined value included in the each region;

a second obtaining portion configured to obtain, for each region of the plurality of regions, a second ratio by dividing the total number of the pixels having the density equal to or higher than the predetermined value included in the each region by a total number of the pixels included in the each region;

a first determining portion configured to determine a target temperature for maintaining a temperature of the fixing portion on the basis of the first ratio and the second ratio; and a control portion configured to control power to be supplied to the fixing portion so that the temperature of the fixing portion is maintained at the target temperature.

2. The image forming apparatus according to claim 1, wherein the predetermined direction is a main scanning direction which coincides with a direction orthogonal to a direction in which the recording material is transported.

3. The image forming apparatus according to claim 1, wherein the predetermined direction is a sub scanning direction which coincides with a direction in which the recording material is transported.

4. The image forming apparatus according to claim 1, wherein the plurality of groups includes a first group including the pixels having the density equal to or higher than the predetermined value and arranged consecutively in a main scanning direction which coincides with a direction orthogonal to a direction in which the recording material is transported and a second group including the pixels having the density equal to or higher than the predetermined value and arranged consecutively in a sub scanning direction which coincides with the transporting direction.

5. The image forming apparatus according to claim 1, wherein a consecutive number of the pixels having the density equal to or higher than the predetermined value is a predetermined number.

6. The image forming apparatus according to claim 1, further comprising:

a second determining portion configured to determine, for each region of the plurality of regions, whether the first ratio is less than a first threshold and whether the second ratio is less than a second threshold, wherein the first determining portion determines, for all of the plurality of regions, a temperature less than a first predetermined temperature as the target temperature when it is determined that the first ratio is less than the first threshold and the second ratio is less than the second threshold.

7. The image forming apparatus according to claim 6, wherein the first predetermined temperature is determined when it is determined, for at least one of the plurality of regions, that the first ratio is at least the first threshold or the second ratio is at least the second threshold.

8. The image forming apparatus according to claim 1, further comprising:

a second determining portion configured to determine, for each region of the plurality of regions, whether the first ratio is less than a first threshold and whether the second ratio is less than a second threshold, wherein the first determining portion determines a temperature higher than a second predetermined temperature as the target temperature when it is determined, for at least one of the plurality of regions, that the first ratio is at least the first threshold or the second ratio is at least the second threshold.

9. The image forming apparatus according to claim 8, wherein the second predetermined temperature is determined when it is determined, for all of the plurality of regions, that the first ratio is less than the first threshold and the second ratio is less than the second threshold.

10. The image forming apparatus according to claim 8, wherein the first determining portion determines the target temperature according to a total number of the pixels having the density equal to or higher than the predetermined value and included in the plurality of regions.

11. The image forming apparatus according to claim 8, wherein the first determining portion determines the target temperature according to a total number of pixels having the density equal to or higher than the predetermined value and included in at least two regions connected with each other among the plurality of regions.

12. The image forming apparatus according to claim 1, wherein the pixels having the density equal to or higher than the predetermined value are pixels other than white pixels.

13. An image forming method for an image forming apparatus comprising a fixing portion configured to fix a toner image formed in accordance with image data on a recording material, a computer executing the following steps:

a processing step of dividing the image data into a plurality of regions including a plurality of pixels;

a first obtaining step of obtaining, for each region of the plurality of regions, in a case each group of a plurality of group includes the plurality of pixels having a density equal to or higher than a predetermined value and arranged consecutively in a predetermined direction in the each region, a first ratio by dividing a total number of the pixels included in the plurality of groups by a total number of the pixels having the density equal to or higher than the predetermined value included in the each region;

a second obtaining step of obtaining, for each region of the plurality of regions, a second ratio by dividing the total number of the pixels having the density equal to or higher than the predetermined value included in the each region by a total number of the pixels included in the each region;

a determining step of determining a target temperature for maintaining a temperature of the fixing portion on the basis of the first ratio and the second ratio; and a control step of controlling power to be supplied to the fixing portion so that the temperature of the fixing portion is maintained at the target temperature.

14. A computer-readable recording medium recording a program, the program causing a computer to execute:

a processing step of dividing the image data into a plurality of regions including a plurality of pixels;

a first obtaining step of obtaining, for each region of the plurality of regions, in a case each group of a plurality of group includes the plurality of pixels having a density equal to or higher than a predetermined value and arranged consecutively in a predetermined direction in the each region, a first ratio by dividing a total number of the pixels included in the plurality of groups by a total number of the pixels having the density equal to or higher than the predetermined value included in the each region;

a second obtaining step of obtaining, for each region of the plurality of regions, a second ratio by dividing the total number of the pixels having the density equal to or higher than the predetermined value included in the each region by a total number of the pixels included in the each region;

a determining step of determining a target temperature for maintaining a temperature of a fixing portion on the basis of the first ratio and the second ratio, the fixing portion fixing a toner image formed in accordance with the image data on a recording material; and a control step of controlling power to be supplied to the fixing portion so that the temperature of the fixing portion is maintained at the target temperature.

* * * * *